US007301270B2

(12) United States Patent
Moon

(10) Patent No.: US 7,301,270 B2
(45) Date of Patent: Nov. 27, 2007

(54) FIELD EMISSION DISPLAY DEVICE HAVING PLURALITY OF EMITTERS WITH A COMMON GATE ELECTRODE

(75) Inventor: Seong-Hak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 258 days.

(21) Appl. No.: 10/911,570

(22) Filed: Aug. 5, 2004

(65) Prior Publication Data

US 2005/0029923 A1 Feb. 10, 2005

(30) Foreign Application Priority Data

Aug. 9, 2003 (KR) ..... 10-2003-0055206

(51) Int. Cl.
*H01J 1/62* (2006.01)
*H01J 1/46* (2006.01)

(52) U.S. Cl. ..... 313/497; 313/306; 313/310; 313/495; 313/311

(58) Field of Classification Search ..... 313/495–497, 313/346 R, 336, 309, 306–307
See application file for complete search history.

(56) References Cited

U.S. PATENT DOCUMENTS

| | | | | |
|---|---|---|---|---|
| 5,828,163 | A * | 10/1998 | Jones et al. | 313/336 |
| 6,144,145 | A * | 11/2000 | Jones et al. | 313/311 |
| 6,169,372 | B1 | 1/2001 | Kobayashi et al. | |
| 6,184,850 | B1 * | 2/2001 | Suzuki et al. | 345/74.1 |
| 6,265,822 | B1 * | 7/2001 | Kuroda et al. | 313/495 |
| 6,313,815 | B1 * | 11/2001 | Takeda et al. | 345/75.2 |
| 6,646,282 | B1 | 11/2003 | Chen | |
| 2004/0108515 | A1 * | 6/2004 | Muroyama et al. | 257/144 |

* cited by examiner

*Primary Examiner*—Mariceli Santiago
*Assistant Examiner*—Anne M Hines
(74) *Attorney, Agent, or Firm*—Birch, Stewart, Kolasch & Birch, LLP

(57) ABSTRACT

An FED device includes an anode electrode formed on a substrate; a phosphor layer formed on the anode electrode; and field emission devices for emitting at least two electron beams onto the phosphor layer. An area where a fluorescent material is excited can be enlarged and luminance and efficiency of the FED can be enhanced.

13 Claims, 4 Drawing Sheets

FIELD EMISSION DISPLAY DEVICE HAVING PLURALITY OF EMITTERS WITH A COMMON GATE ELECTRODE

This Non-provisional application claims priority under 35 U.S.C. § 119(a) on Patent Application No(s). 10-2003-0055206 filed in Korea, Democratic People's Republic of on Aug. 9, 2003, the entire contents of which are hereby incorporated by reference.

BACKGROUND OF THE INVENTION

1. Field of the Invention

The present invention relates to a field emission display (FED) and especially, to an FED device.

2. Description of the Background Art

Recently, with the development in the telecommunication techniques, demands on displays are increasing and structures of displays are varied. For instance, in environment requesting mobility such as mobile type information appliances, a light, small display with smaller power consumption is favored, while a display is used as a general information transfer medium, it needs to have a large screen such as a CRT (Cathode Ray Tube), an LCD (Liquid Crystal Display), a PDP (Plasma Display Panel), a VFD (Vacuum Fluorescent Display).

Accordingly, developments of a compact FED that can have high resolution but reduced power consumption are actively ongoing.

The FED receives an attention as a next-generation telecommunication flat display, because it overcomes shortcomings of flat displays (e.g., the LCD, the PDP and the VFD) which are under development or mass-produced.

The FED device has lots of merits as a display device in that it has a simple electrode structure, operates at high speed under the same principle as the CRT and has an infinite color, infinite gray scale and high luminance.

FIG. 1 is a sectional view showing the structure of a general field emission display device.

As shown in FIG. 1, the FED device includes a lower glass substrate 1; a cathode electrode 2 formed on the lower glass substrate 1; an emitter 5 and an insulator layer 3 formed at a portion of the cathode electrode 2; a gate electrode 4 formed on the insulator layer 3; an upper glass substrate 9; an anode electrode 8 formed on the upper glass substrate 9 and applying a high voltage so that electron beams can be generated from the emitter 5; a phosphor layer 7 excited by electron beams emitted from the emitter 5 by the high voltage to emit visible rays; and a spacer 6 disposed between the gate electrode and the anode electrode 8 in order to support the upper glass substrate 9 and the lower glass substrate 1.

The emitter 5 is formed in a micro tip shape and has excellent electron emission characteristics, but in order to fabricate a display device with a large screen of 20 inches or wider, a large-scale equipment are required and its fabrication processes are complicate.

A conventional surface conduction type FED device has a simple structure and commonly used for a large-screen display device.

The construction of the surface conduction type FED device will now be described with reference to FIG. 2.

FIG. 2 is a sectional view showing the structure of the surface conduction type FED device in accordance with a conventional art.

As shown in FIG. 2, the surface conduction type FED device includes: a lower glass substrate 17; a gate electrode 16 and a cathode electrode 14 formed on the lower glass substrate 17; a first emitter 15-1 formed on a portion of the cathode electrode 14; a second emitter 15-2 formed on a portion of the gate electrode 16; an upper glass substrate 11; an anode electrode 12 formed on the upper glass substrate 11 and applying a high voltage; and a phosphor layer 13 formed on the anode electrode 12 and emitting visible lights by being excited by electron beams generated by the first and second emitters 15-1 and 15-2 by the high voltage.

A narrow gap 18 is formed between the first and second emitters 15-1 and 1502. When a threshold voltage is applied to the gate electrode 16 and the cathode electrode 14 formed at the lower portion of the first and second emitters 15-1 and 15-2, high electric field is generated at the gap 18, by which electrons are emitted.

The electrons emitted by the first and second emitters 15-1 and 15-2 are accelerate by the high voltage applied to the anode electrode 12 and converted into electron beams, which is then converged on the phosphor layer 13. Then, the phosphor layer 13 is excited by the electron beams to emit visible rays. Herein, the first and second emitters 15-1 and 15-2, the gate electrode 16 and the cathode electrode 14 are called a single field emission device.

A matrix structure of the surface conduction type FED device employing the FED will now be described with reference to FIG. 3.

FIG. 3 illustrates an example of a matrix structure in accordance with the surface conduction type FED device in accordance with the conventional art.

As shown in FIG. 3, the surface conduction type FED device includes: a plurality of scan lines Scan 1~Scan N; a plurality of data lines D1~Dm 30 crossing the plurality of scan lines Scan 1~Scan N; and FED devices formed at the crossings of the scan lines (e.g., Scan 1) and data lines (e.g., D1).

A field emission device of the FED device is installed at each of a red pixel, a green pixel and a blue pixel. The gate electrode 16 of the field emission device is electrically connected to the data line (e.g., D1) and the cathode electrode 14 of the field emission device is electrically connected to the scan line (e.g., Scan 1).

For example, in the matrix structure of the surface conduction type FED, when a threshold voltage is applied to the first scan line Scan 1 and the first data line D1, a field emission device electrically connected to the first scan line (Scan 1) and the data line (D1) emits electron beams and the electron beams excite a fluorescent material (e.g., a red fluorescent material). At this time, an area 100 of electron beams emitted from one field emission device is smaller than an area of the phosphor layer 13. Namely, since the electron beams emitted from one field emission device is smaller than the area of the phosphor layer 13, the overall area of the phosphor layer 13 cannot be excited.

The area of the electron beams converged on the phosphor layer 13 will be described with reference to FIG. 4 as follows.

FIG. 4 illustrates the area of electron beams emitted from the field emission device of the surface conduction FED device in accordance with the conventional art.

As shown in FIG. 4, the electrons are emitted in the direction of the anode electrode due to a tunneling effect by the first and second emitters 15-1 and 15-2 of the field emission device. Thus, electrons emitted by the first and second emitters 15-1 and 15-2 are bent in the direction of the gate electrode and accelerated in the direction of the anode electrode 12. Electrons (electron beams) accelerated in the direction of the anode electrode excite only a portion of the phosphor layer 13, causing a problem of degradation of luminance and efficiency of the surface.

Thus, as mentioned above, the conventional surface conduction type FED device is disadvantageous that since the electron beams emitted from the field emission device excites only a portion of the phosphor layer, luminance and efficiency of the surface conduction type FED device deteriorate.

The conventional field emission device and the techniques for the FED device are also disclosed in U.S. Pat. Nos. 6,169,372 and 6,646,282.

SUMMARY OF THE INVENTION

Therefore, one object of the present invention is to provide a field emission display (FED) device capable of enlarging an area where a fluorescent material is excited and enhancing luminance and efficiency by having at least two field emission devices.

To achieve the above and other objects, there is also provided an FED device including: a substrate; an anode electrode formed on the substrate; a single phosphor layer formed on the anode electrode; and field emission devices for emitting first and second electron beams onto the single phosphor layer.

To achieve the above object, there is also provided an FED device including: a substrate; an anode electrode formed on the substrate; a single phosphor layer formed on the anode electrode; and field emission devices for emitting first and second electron beams onto the single phosphor layer.

To achieve the above and other objects, there is also provided an FED device including: an upper glass substrate; an anode electrode formed on the upper glass substrate and applying a high voltage; a phosphor layer formed on the anode electrode and emitting visible rays by being excited by electron beams generated by the high voltage; and two field emission devices for emitting electron beams onto the phosphor layer.

The two field emission devices, respectively, include: a first cathode electrode, a common gate electrode and a second cathode electrode formed on the same plane of the lower glass substrate; a first emitter formed on a portion of the first cathode electrode; a second emitter formed on a portion of the common gate electrode; a third emitter formed on a portion of the second cathode electrode; and a fourth emitter formed on a portion of the common gate electrode.

The common gate electrode is formed between the first and second cathode electrodes.

To achieve the above and other objects, there is also provided an FED device including: an anode electrode formed on an tipper glass substrate; a phosphor layer formed on the anode electrode; a lower glass substrate; first cathode electrode, a common gate electrode and second cathode electrode formed on the same plane of the lower glass substrate; a first emitter formed on a portion of the first cathode electrode; a second emitter formed on a portion of the common gate electrode; a third emitter formed on a portion of the second cathode electrode; and a fourth emitter formed on a portion of the common gate electrode.

A gap between the first and second emitters is as wide as a gap between the third and fourth emitters and narrower than a gap between the common gate electrode and the first cathode electrode.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

A field emission display (FED) device, which is capable of enlarging an area where a fluorescent material is excited and enhancing luminance and efficiency by having at least two field emission devices, in accordance with a preferred embodiment of the present invention will now be described with reference to FIGS. 5 to 7.

The construction of an FED device having the two field emission devices will be described in detail as follows with reference to FIG. 5.

Figure 1:
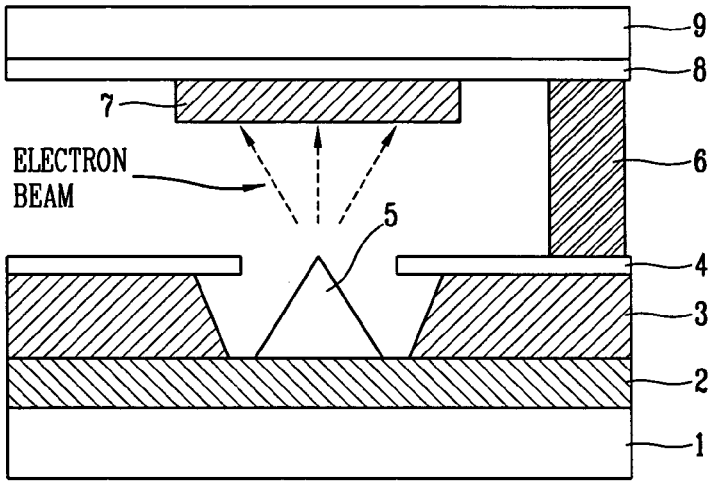
FIG. 1 PRIOR ART
FIG. 1 illustrates the structure of a general FED device.
Figure 2:
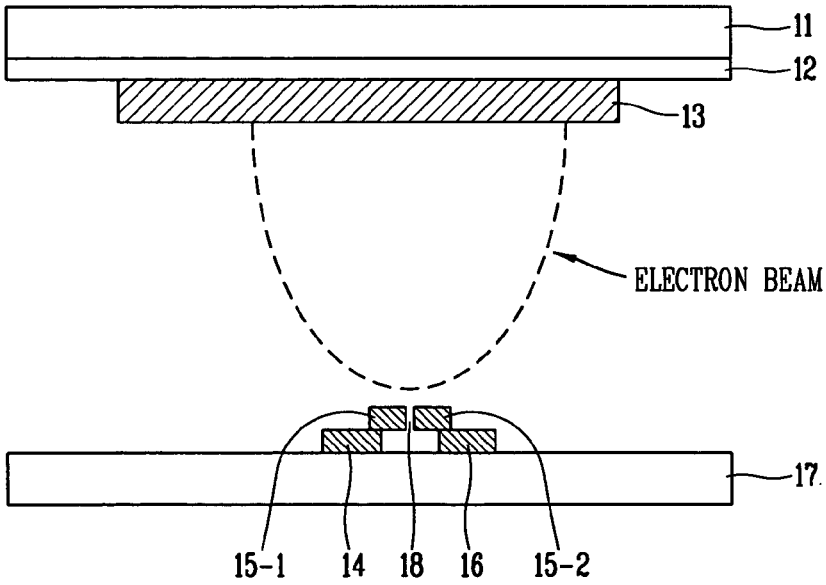
FIG. 2 PRIOR ART
FIG. 2 is a sectional view showing the structure of a surface conduction type FED device in accordance with a conventional art.
Figure 3:
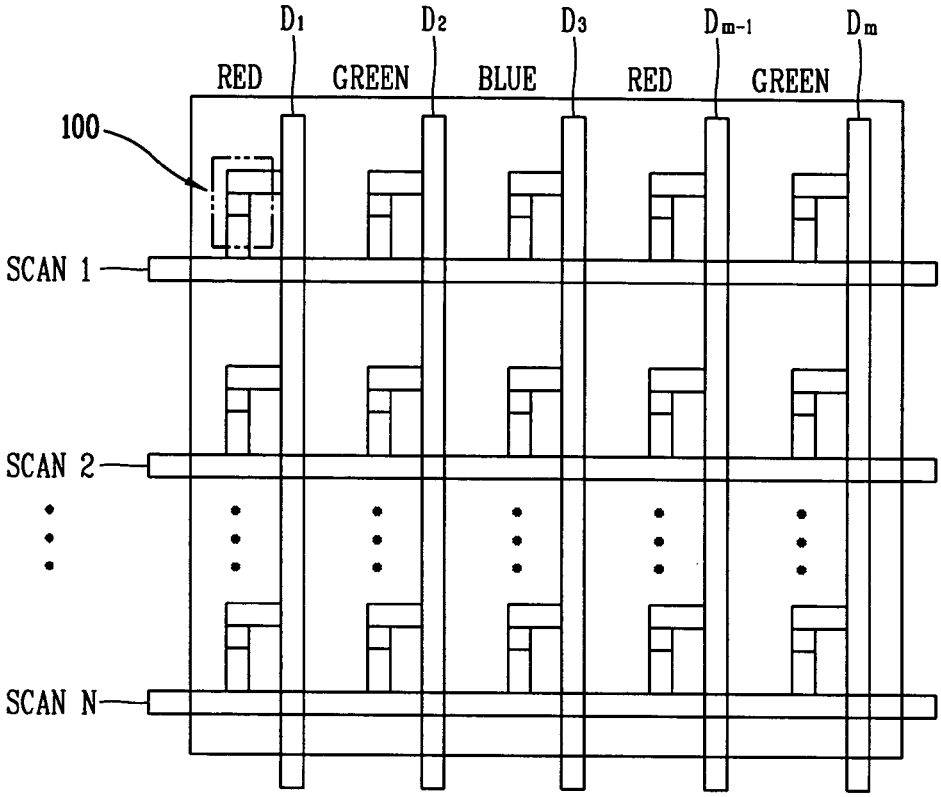
FIG. 3 PRIOR ART
FIG. 3 illustrates an example of a matrix structure of the surface conduction type FED device in accordance with the conventional art.
Figure 4:
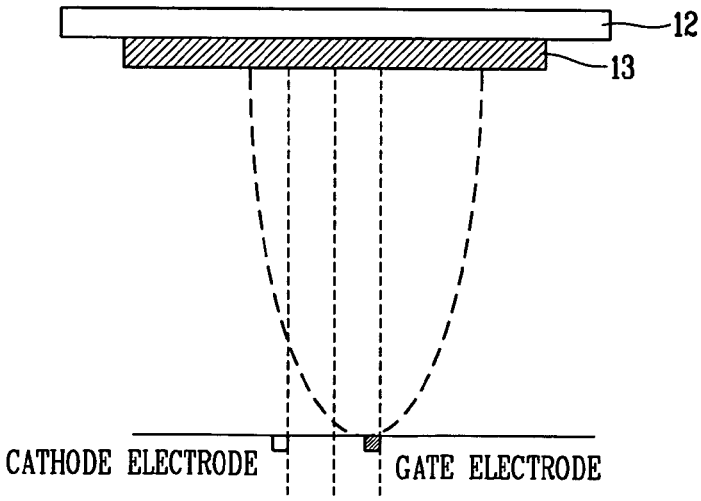
FIG. 4 PRIOR ART
FIG. 4 shows an area of electron beams emitted from the field emission device of the surface conduction FED device in accordance with the conventional art.
Figure 5:
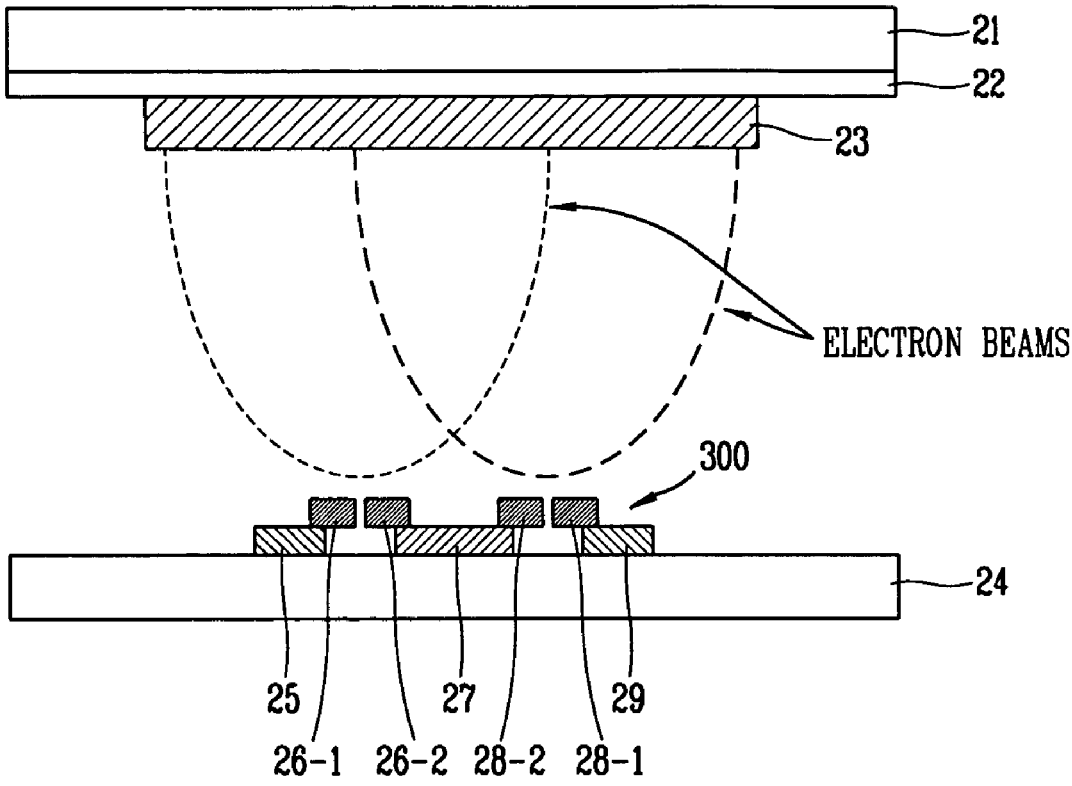
FIG. 5 illustrates the construction of an FED device in accordance with the present invention.

FIG. 5 illustrates the construction of an FED device in accordance with the present invention.

As shown in FIG. 5, the FED device in accordance with the present invention includes: an upper glass substrate 21; an anode electrode 22 formed on the upper glass substrate 21; a phosphor layer 23 formed on the anode electrode 22; a lower glass substrate 24; and two field emission devices 300 formed on the lower glass substrate 24 and emitting two electron beams.

The field emission device includes a cathode electrode 25 and a gate electrode 27 formed on the same plane of the lower glass substrate 24; a first emitter 26-1 formed on a portion of the cathode electrode 25; and a second emitter 26-2 formed on a portion of the gate electrode 27.

For instance, preferably, the two field emission devices, respectively, include a first cathode electrode 25, the common gate electrode 27 and a second cathode electrode 29 formed on the same plane of the lower glass substrate 24; the first emitter 26-1 formed on a portion of the first cathode electrode 25; a second emitter 26-2 formed on a portion of the common gate electrode 27; a third emitter 28-1 formed on a portion of the second cathode electrode 29; and a fourth emitter 28-2 formed on a portion of the common gate electrode 27.

A gap between the first and second emitters 26-1 and 26-2 is the same as a gap between the third and fourth emitters 28-1 and 28-2 and narrower than a gap between the common gate electrode 27 and the cathode electrode 25.

The common gate electrode 27 of the field emission device is formed between the cathode electrodes 25 so that electron beams can be converged on the entire surface of the phosphor layer 23. One electron beam is generated by field between the first and second emitters 26-1 and 26-2, and another electron beam is generated by a field between the third and fourth emitters 28-2. That is, the field emission devices emit two electron beams on the single phosphor layer 23.

The matrix structure of the surface conduction type FED in accordance with the present invention will now be described with reference to FIG. 6.

Figure 6:
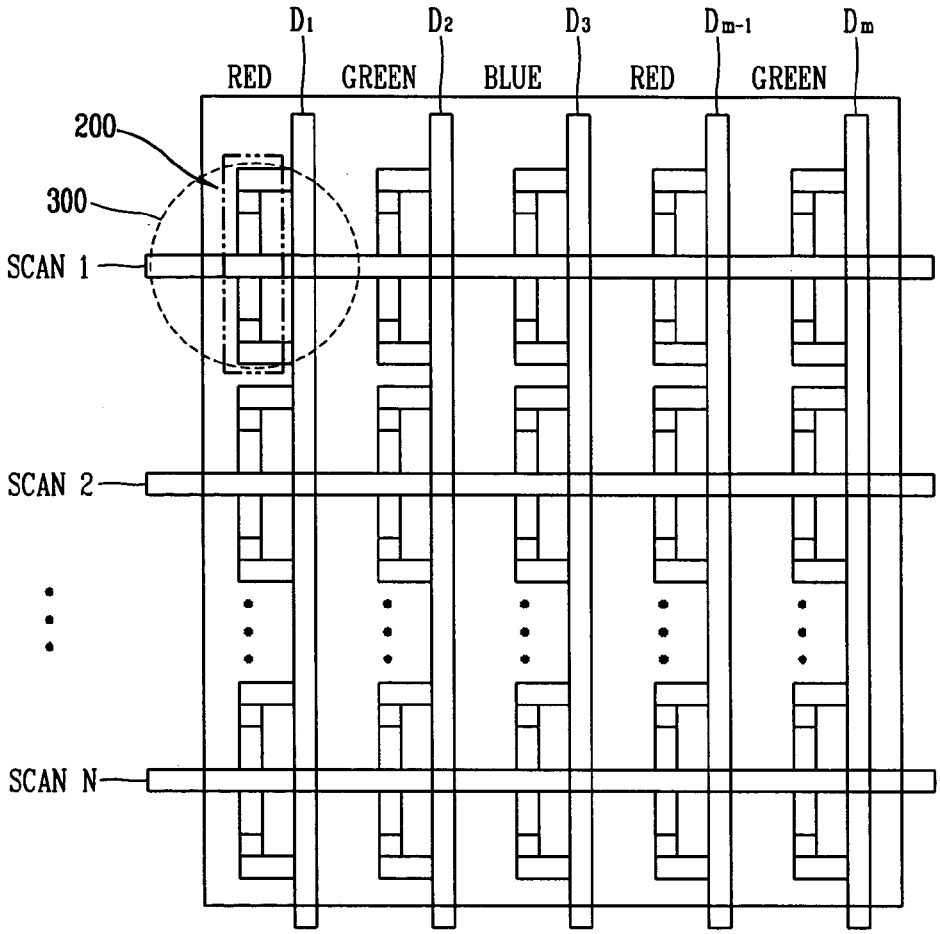
FIG. 6 illustrates an example of a matrix structure of a surface conduction type FED in accordance with the present invention.

FIG. 6 illustrates an example of a matrix structure of a surface conduction type FED in accordance with the present invention.

As shown in FIG. 6, the surface conduction type FED includes: a plurality of scan lines Scan 1~Scan N; a plurality of data lines D1~Dm 30 crossing the plurality of scan lines Scan 1~Scan N; and FED devices formed at the crossings of the scan lines (e.g., Scan 1) and data lines (e.g., D1).

Two field emission devices of the FED device are installed at each of a red pixel, a green pixel and a blue pixel. The common gate electrode 27 of each field emission device is electrically connected to the data line (e.g., D1) and the cathode electrodes 25 and 29 of each field emission device are electrically connected to the scan line (e.g., Scan 1).

For instance, in one surface conduction type FED device, two field emission devices 300 are formed at the left side of the data line (e.g., D1) symmetrically up and down centering on the scan line (e.g., Scan 1). In this case, if the electrodes 27 and 29 positioned at a lower portion of the scan line (Scan 1) are formed in order of the cathode electrode 29 and the common gate electrode 27, then, preferably, the electrodes 25 and 27 of the field emission device positioned at an upper portion of the scan line (Scan 1) are formed in order of the common gate electrode 27 and the cathode electrode 25.

Cells (the surface conduction type FED devices) each having the two field emission devices are arranged in order of red, green and blue from the left to the right.

Accordingly, when a threshold voltage is applied to the first scan line (Scan 1) and the first data line (D1), the two field emission devices 300 are simultaneously driven and emit electrons. The emitted electrons are applied to the anode electrode 22 and then accelerated by a high voltage which has been applied to the anode electrode, to thereby excite the entire area of the phosphor layer 23. At this time, since one common gate electrode 27 is formed between the cathode electrodes 25 and 29 of the field emission devices 300, an area 200 of electron beams exciting the phosphor layer 23 is enlarged.

The area of electron beams converged on the phosphor layer 23 after having been emitted from the field emission devices 300 of the surface conduction type FED device driven by the first data line D1 and the first scan line Scan 1 will now be described with reference to FIG. 7. One electron beam is emitted on the left side from the central portion of the single phosphor layer 23, and the other electron beam is emitted from the central portion onto the right side of the single phosphor layer 23.

Figure 7:
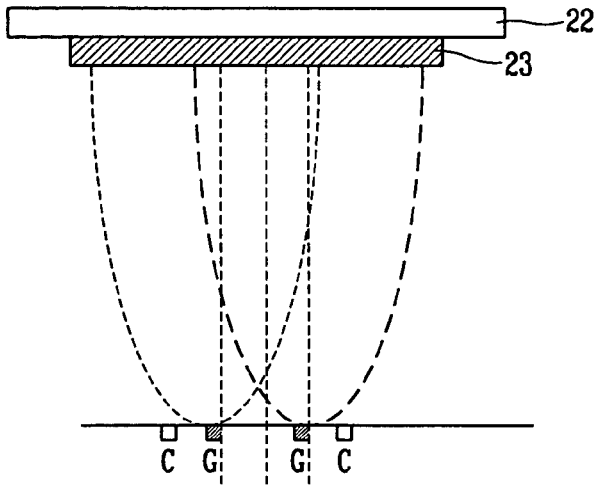
FIG. 7 shows an area of electron beams emitted from the field emission device of the surface conduction FED device in accordance with the present invention.

FIG. 7 shows an area of electron beams emitted from the field emission device of the surface conduction FED device in accordance with the present invention.

As shown in FIG. 7, the electrons (electron beams) are emitted from the field emission devices 300 toward the anode electrode by being bent fro the direction of the cathode electrode (C) to the direction of the common gate electrode (G) due to a tunneling effect. Namely, the locus of the two electron beams emitted fro the field emission devices 300 are symmetrical on the basis of the center of the phosphor layer 23, and accordingly, the area of the phosphor layer 23 emitting visible rays by the two electron beams emitted form the field emission devices 300 is enlarged compared to the conventional art.

Though only two field emission devices are formed to emit two electron beams on the phosphor layer in the preferred embodiment of the present invention, multiple field emission devices can be constructed to generate multiple electron beams, and the field emission devices in accordance with the present invention can be applied to every display device emitting electron beams.

As so far described, the FED device of the present invention has the following advantages.

That is, for example, by forming the field emission devices emitting electron beams to the FED device, the entire area of the phosphor layer can be excited. Namely, since the entire area of the phosphor layer are excited through electron beams emitted by the field emission devices, luminance and efficiency of the FED can be increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An FED device comprising:

an anode electrode formed on a substrate;

a phosphor layer formed on the anode electrode; and two field emission devices for emitting at least two electron beams onto the phosphor layer, wherein each field emission device comprises a gate electrode and a cathode electrode formed on a lower substrate, a first emitter formed on the gate electrode, and a second emitter formed on the cathode electrode, wherein the two field emission devices have one common gate electrode, and the common gate electrode is formed between the cathode electrodes of the two field emission devices.

2. The device of claim 1, wherein a gap between the first and second emitters is narrower than a gap between the gate electrode and the cathode electrode.

3. The device of claim 1, wherein each electron beam is generated by a tip of the emitter.

4. A field emission device, comprising:

a first cathode electrode, a common gate electrode and a second cathode electrode formed on the same plane of a lower glass substrate;

a first emitter formed on a portion of the first cathode electrode;

a second emitter formed on a portion of the common gate electrode;

a third emitter formed on a portion of the second cathode electrode; and a fourth emitter formed on a portion of the common gate electrode, wherein the common gate electrode is formed between the first and second cathode electrodes.

5. The device of claim 4, wherein a gap between the first and second emitters is the same as a gap between the third and fourth emitters and is narrower than a gap between the common gate electrode and the first cathode electrode.

6. An FED device comprising:

a substrate;

an anode electrode formed on the substrate;

a single phosphor layer formed on the anode electrode; and a field emission device for emitting electron beams emitted from at least two pairs of emitters onto the single phosphor layer, wherein the field emission device further includes at least a pair of cathode electrodes for the at least two pairs of emitters.

7. The device of claim 6, wherein the first electron beam is emitted onto a left side from a central portion of the single phosphor layer, and the second electron beam is emitted onto a right side from the central portion of the single phosphor layer.

8. The FED device of claim 6, wherein the field emission device further includes at least one common gate electrode for the at least two pairs of emitters.

9. An FED device comprising:

an upper glass substrate;

an anode electrode formed on the upper glass substrate and applying a high voltage;

a phosphor layer formed on the anode electrode and emitting visible rays by being excited by electron beams generated by the high voltage; and two field emission devices for emitting electron beams onto the phosphor layer, wherein the two field emission devices, respectively, comprise:

a first cathode electrode, a common gate electrode and a second cathode electrode formed on the same plane of the lower glass substrate;

a first emitter formed on a portion of the first cathode electrode;

a second emitter formed on a portion of the common gate electrode;

a third emitter formed on a portion of the second cathode electrode; and a fourth emitter formed on a portion of the common gate electrode, wherein the common gate electrode is formed between the first cathode electrode and the second cathode electrode.

10. An FED device comprising:

an anode electrode formed on an upper glass substrate;

a phosphor layer formed on the anode electrode;

a lower glass substrate;

a first cathode electrode, a common gate electrode and a second cathode electrode formed on the same plane of the lower glass substrate;

a first emitter formed on a portion of the first cathode electrode;

a second emitter formed on a portion of the common gate electrode;

a third emitter formed on a portion of the second cathode electrode; and a fourth emitter formed on a portion of the common gate electrode, wherein a gap between the first and second emitters is the same as a gap between the third and fourth emitters and is narrower than a gap between the common gate electrode and the first cathode electrode.

11. The device of claim 10, wherein the common gate electrode of the field emission devices is formed between the first and second cathode electrodes so that electron beams can be converged on the substantially entire surface of the phosphor layer.

12. The device of claim 10, wherein one electron beam is generated by the first and second emitters and another electron beam is generated by the third and fourth emitters.

13. A field emission device comprising:

a gate electrode formed on a substrate;

a first cathode electrode and a second cathode electrode formed on the substrate;

at least one pair of emitters formed on the gate electrode;

at least one first emitter formed on the first cathode electrode; and at least one second emitter formed on the second cathode electrode.

* * * * *